United States Patent [19]

Hartman

[11] 4,155,343

[45] May 22, 1979

[54] SAFETY DEVICE FOR STOVE

[75] Inventor: Dorothy M. Hartman, 7972 Provident Rd., Philadelphia, Pa. 19150

[73] Assignee: Dorothy M. Hartman, Philadelphia, Pa.

[21] Appl. No.: 842,708

[22] Filed: Oct. 17, 1977

[51] Int. Cl.[2] ..... F24C 15/10

[52] U.S. Cl. ..... 126/211; 126/24

[58] Field of Search ..... 126/42, 24, 214 R, 214 D, 126/211, 37 A

[56] References Cited

U.S. PATENT DOCUMENTS

| | | | |
|---|---|---|---|
| 2,699,162 | 1/1955 | Nazzaro | 126/24 X |
| 3,513,826 | 5/1970 | Hellmuth | 126/42 X |

FOREIGN PATENT DOCUMENTS

| | | | |
|---|---|---|---|
| 859060 | 12/1952 | Fed. Rep. of Germany | 126/24 |
| 1139956 | 11/1962 | Fed. Rep. of Germany | 126/211 |
| 798376 | 7/1958 | United Kingdom | 126/24 |
| 924944 | 5/1963 | United Kingdom | 126/211 |

*Primary Examiner*—Edward G. Favors

*Attorney, Agent, or Firm*—Caesar, Rivise, Bernstein & Cohen, Ltd.

[57] ABSTRACT

A safety device for use on the top of a stove or in combination with a range. The safety device comprises a plate pivotally mounted on the front of the stove, which plate is adapted to be pivoted to a horizontal position overlying the front burners of the stove. The purpose of the device is to prevent small children from touching the hot front burners of the stove or from pulling any pots or pans on the front burners of the stove onto himself.

7 Claims, 6 Drawing Figures

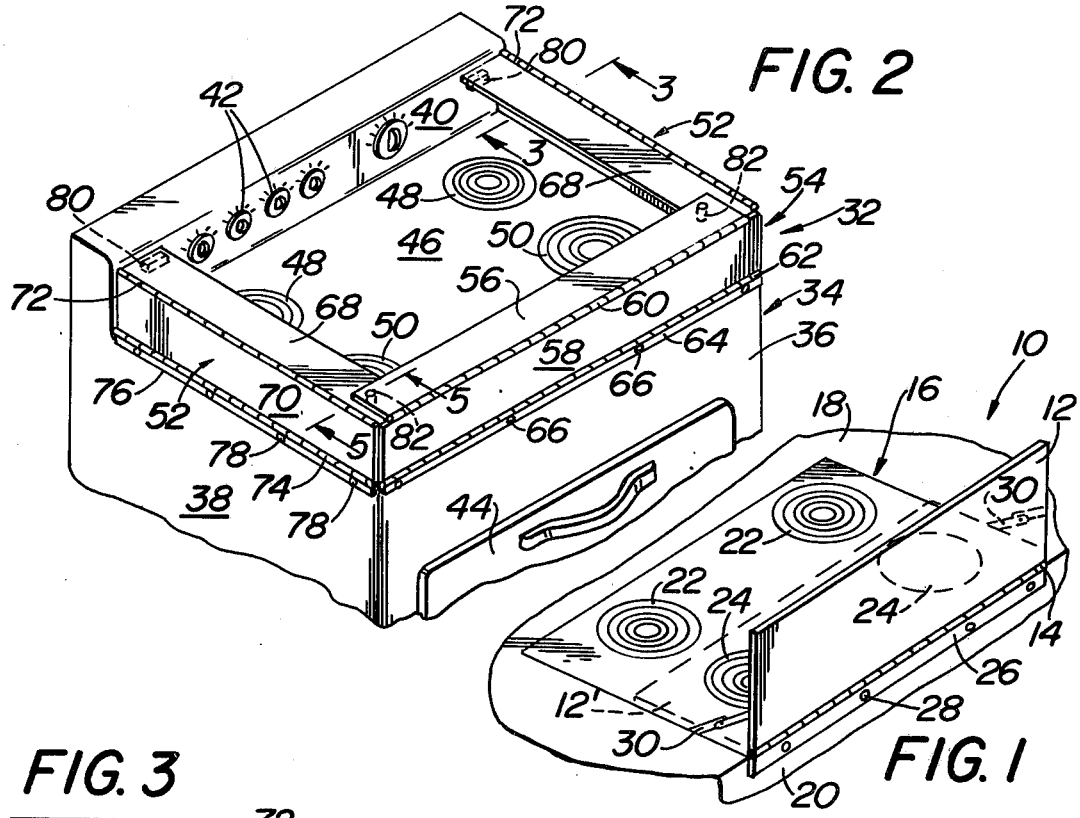
FIG. 2
FIG. 1
FIG. 3
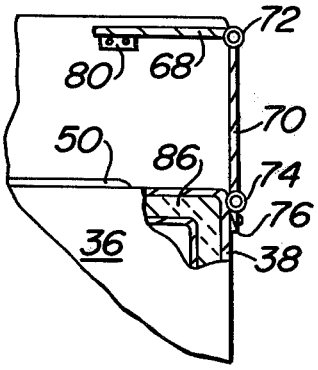
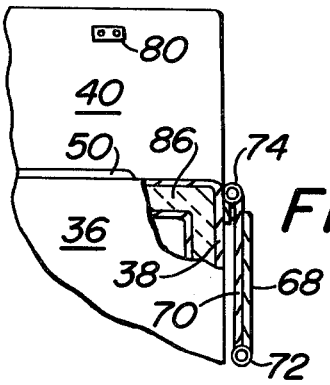
FIG. 4
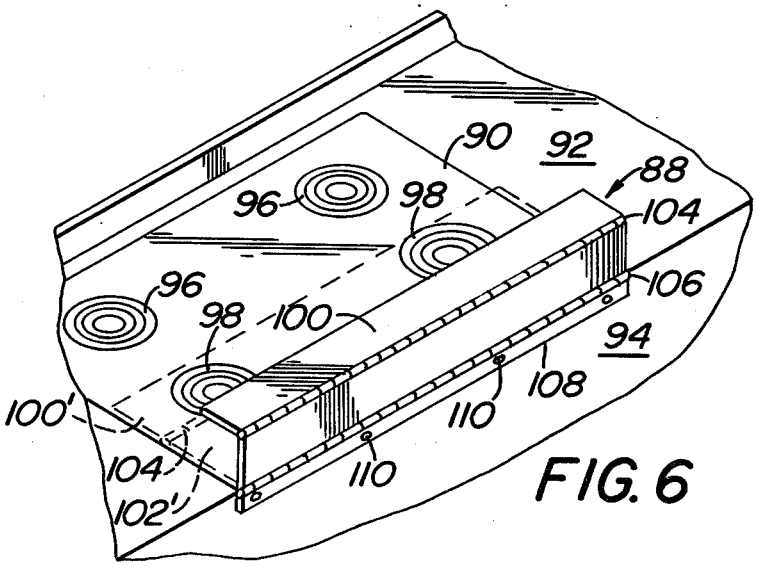
FIG. 6
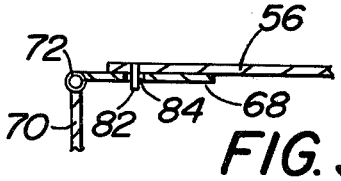
FIG. 5

SAFETY DEVICE FOR STOVE

This invention relates to a safety device for a stove, and more particularly, to a device secured on a stove in order to prevent a child from reaching the burners on the stove or from pulling any pots or pans on the burners onto himself.

The range tops on stoves are normally positioned at a height wherein a young child could reach up and touch the front burners or pull any cooking vessels on the front burners onto himself. This creates an obvious danger to the children, if they should be left unattended in a kitchen or if they should walk into a kitchen when their mother is out of the kitchen and the range or stove top is in use. Serious injury could result to the child if he were to touch a hot burner or pull a cooking vessel from the burner onto himself.

The existence of the problem was recently recognized in U.S. Pat. No. 3,513,826. In that patent, a device is disclosed which will prevent a young child from reaching the burners on a stove or from reaching any pot on the burner. The device disclosed in the patent comprises a plurality of telescoped rails which can be adjusted for size according to the size of the stove top. The device is held in place by magnets on the rails, which in turn magnetically connect the device to the stove top.

The device of the instant invention provides a number of distinct advantages over the device shown in U.S. Pat. No. 3,513,826. The device of the instant invention is permanently attached to the stove, and accordingly is always available for use. In the device shown in U.S. Pat. No. 3,513,826, the device has a magnetically secured attachment, which is readily adapted for removal and storage. Thus, since it may not always be present on the stove for use, a woman may inadvertently neglect to secure the device in place when cooking, and therefore the device would not be available for its intended purpose.

Another advantage of the instant invention over the device shown in U.S. Pat. No. 3,513,826 is the fact that the device is rigidly secured in place when in use. Thus, there is no possibility of a child's removing the device by giving it a sudden pull. It would be possible for a child to remove the magnetically secured device shown in U.S. Pat. No. 3,513,826.

Another advantage of the device of the instant invention is that when it is not in use, it can be laid flat over the front two burners. Accordingly, when a woman is utilizing only the rear two burners on the stove, the device can serve as a shelf in connection with preparing the food to be cooked on the rear two burners.

It is accordingly an object of this invention to provide a novel safety device for a stove.

It is another object of this invention to provide a safety device for a stove that is permanently secured in place, and is rigidly secured in place when in use.

These and other objects of this invention are accomplished by providing a safety device for a stove which comprises, in combination, a stove top having a plurality of burners thereon and a plate pivotally mounted to said stove top, and forwardly of said burners, said plate being adapted to be pivoted from a vertical position, whereby said plate provides a wall in front of said burners, to a second position at least 90° from said vertical position, and means for maintaining said plate in said vertical position.

Other objects and many of the attendant advantages of this invention will be readily appreciated as the same becomes better understood by reference to the following detailed description when considered in connection with the accompanying drawing wherein:

FIG. 1 is a partial perspective view showing one embodiment of the device of this invention as mounted on a stove;

FIG. 2 is a partial perspective view of a second embodiment of the device of this invention, as mounted on a stove;

FIG. 3 is an enlarged sectional view taken along the line 3—3 of FIG. 2;

FIG. 4 is a sectional view similar to FIG. 3, but showing a side portion of the device of this invention in a collapsed condition;

FIG. 5 is an enlarged sectional view taken along the line 5—5 of FIG. 2; and FIG. 6 is a partial perspective view of a modified embodiment of the device of FIG. 2.

Referring now in greater detail to the various figures of the drawings wherein like reference characters refer to like parts, a first embodiment of the safety device of this invention is generally shown at 10 in FIG. 1. Device 10 basically comprises a plate 12 pivotally mounted on a hinge 14. Hinge 14 is of the piano-type, and extends along the entire length of plate 12. Preferably, the hinge is a standard frictional hinge, whereby the hinge will hold the plate 14 in any angular position to which it is pivoted.

The device 10 is mounted on any conventional stove top, such as stove top 16. The stove top 16 is mounted on a countertop 18, with the counter having a front wall 20. A pair of rear burners 22 and a pair of front burners 24 are positioned on the stove top. The burners can be heated by any conventional means, such as gas or electricity. Any of the stove tops known to the art can be used in carrying out this invention, and the specific structure of the stove top is not critical to the invention.

The plate 12 and its associated hinge 14 are secured on the front wall 20 of the counter by dependent bar 26 secured to the hinge 14 and by any conventional securing means, such as screws 28. The plate 12 is held in a vertical position by a pair of collapsible braces 30, of conventional design. Braces 30 can be mounted on the top 18 of the counter or stove by any conventional means.

With the plate 12 in the position shown in full line in FIG. 1, a child will be prevented from contacting the front burners 24 of the stove or contacting any cooking vessels thereon. Thus, the plate 12 is of sufficient height to prevent a young child from reaching over the plate in order to touch the burners or the cooking vessels.

When the front burners 24 are not being used, the braces 30 can be collapsed, and the plate 12 can be pivoted downwardly to the position shown in phantom at 12' in FIG. 1, around hinge 14. With the plate 12 in this horizontal position, the plate will serve as a shelf. Additionally, the user of the stove can use the rear burners 22 without interference from the plate 12. Furthermore, an adult can easily use all four burners of the stove with the plate in the upright position, since this will not interfere with use of the stove by a person of adult height.

A modified embodiment of the device of this invention is generally shown at 32 in FIG. 2. Device 32 is shown as being mounted on a free-standing stove and oven combination 34. Stove and oven 34 is of a conventional construction, and includes a front wall 36, side walls 38 and a rear wall 40 having controls 42 mounted thereon. The front wall 36 includes an oven door 44. The top surface 46 includes rear burners 48 and front burners 50.

The safety device 32 comprises side sections 52 and front section 54. The front section 54 comprises a first plate 56 and a second plate 58 which are joined by a hinge 60. Plate 58 is pivotally mounted on hinge 62 which is in turn secured to plate 64. Plate 64 is in turn secured on the front face 36 of the oven 34 by conventional means, such as screws 66.

Side sections 52 are identical in structure, and each comprises a first plate 68, a second plate 70 and a hinge 72 pivotally connecting the two plates. Plate 70 is pivotally secured to hinge 74, which in turn is secured on side wall 38 via plate 76 and screws 78. In the embodiment of the invention shown at 32, all hinges are of the same type as hinge 14. Thus, they are piano-type hinges which frictionally hold the secured plates in any position to which they are moved.

A pair of bars 80 are secured on rear wall 40. The purpose of bars 80 is to hold the side sections 52 in the position shown in FIG. 2. With the side sections 52 in the position shown, the front section 54 is folded in the position shown in FIG. 2, and pins 82 on the front sections are inserted in openings 84 (FIG. 5) of plates 68 of the side sections.

With the device 32 assembled as shown in FIG. 2, it provides a rigid wall totally surrounding the burners 48 and 50 of the free standing stove and oven 34. A young child cannot pull the device down in view of the interlocking between the pins 82 and the side sections 52. All four burners of the stove can be used and an adult can easily reach the controls 42. However, a young child will be unable to reach any of the burners from any side or the front of the stove, and accordingly will be unable to reach any of the cooking vessels on the burners.

When it is desired to move the device 32 out of the way, as for storage, this is accomplished by pivoting the plate 56 upwardly around hinge 60. This removes pins 82 from openings 84. The plate 58 is then rotated 180° until it abuts the front wall 36 of the stove 34. The plate 56 is folded against the plate 38. In view of the frictional nature of the hinge 60, the plate 56 will remain in its folded position. This will not interfere with the opening and closing of the oven door 44.

Similarly, after the front section 54 is dropped downwardly, the side sections 52 can similarly be dropped. Thus, as seen in FIG. 4, the side sections 52 can be folded against the side walls 38 of the stove, in the same manner as the front section. Thus, the frictional hinge 72 will hold the plates 68 and 70 in their abutting relationship. It should be noted that in FIGS. 3 and 4 the front section 54 has been removed for the sake of clarity. Additionally, the insulation 86 for the oven has been schematically shown.

In FIG. 6, a third embodiment of the invention is generally shown at 88. Embodiment 88 is similar to embodiment 32, with the exception of the fact that embodiment 88 is used in connection with a counter-top range, instead of the free standing oven and range 34. Accordingly, the stove top or range 90 is built into a counter having a top surface 92 and a front surface 94. The stove top or range 90 includes rear burners 96 and front burners 98. The safety device 88 includes a first plate 100, a second plate 102 and a joining hinge 104. Plate 102 is in turn pivotally mounted on hinge 106, which is in turn secured to plate 108. Plate 108 is secured on the front surface 94 of the counter by screws 110. Here again, the hinges 104 and 106 are of the piano-type, and extend along the entire lengths of the associated plates. Additionally, the hinges are standard frictional hinges so that the plates can be held in any preset position.

Device 88 is used in the same manner as front section 54 of device 32. However, since there are no side sections, other means of support can be provided for the device 88. In one embodiment, the plates 100 and 102 can be held in the position shown in FIG. 6 by any suitable means, such as braces similar to braces 30 shown in FIG. 1. Alternatively, because of the frictional nature of the hinges 104 and 106, the device 88 will automatically hold the position shown in FIG. 6. However, for the purpose of stability, it is preferred to add releasable braces to the top plate 100 for rigidly securing the plate 100 in the position shown.

When it is desired to move the device 88 out of the way, it can be folded against the front surface 94 of the counter, in the same manner described with respect to sections 52 and 54 of device 32. Alternatively, the device 88 can be laid horizontally across the front burners 98, with the plates 100 and 102 being in the positions shown at 100' and 102' in FIG. 6. When in this position, the plates serve as a shelf overlying the front burners, in the same manner as plate 12.

It is thus seen that the device of this invention provides a novel safety device for stoves. The device is rigidly secured in place, and no substantial time is required to set the device in order to have it perform its safety function. It is always available for use. However, when desired, the device can conveniently be pivoted out of the way. Additionally, the front section of each embodiment of the device is pivotable to a position wherein it will overly the front burners and serve as a shelf for the woman cooking on the rear burners of the stove.

The device can be used on a free standing stove and oven, as shown in FIG. 2, or on a stove mounted in a countertop, as shown in FIGS. 1 and 6. Because the device is rigidly secured in place, it cannot be pulled from the stove by a young child, as might be possible with the magnetically secured device of U.S. Pat. No. 3,513,826. With the device in place, a young child will not be able to reach the front burners of a stove or any cooking vessels placed thereon. However, an adult can easily reach over the device in order to utilize all four burners on the stove.

In the embodiments of the device shown in FIGS. 1 and 6 in connection with counter-mounted stoves, the controls can be placed at any convenient location, as is customary in the art. Although not critical to the invention, for the purpose of safety, the controls are now usually placed out of reach of small children.

The various embodiments of the device of this invention can be made from any rigid materials that would not be affected by the heat of the stove. Aluminum is a preferred material, because of its low heat conductivity and the fact that it can be given many decorative finishes which would permit it to blend with the stove and the surrounding counters. Other metals that can be used are lead or steel.

Without further elaboration, the foregoing will so fully illustrate my invention, that others may, by applying current or future knowledge, readily adapt the same for use under various conditions of service.

What is claimed as the invention is:

1. A safety device for a stove which comprises, in combination, a stove top having a plurality of burners thereon and a plate pivotally mounted at the front of said stove top, said plate being forward of said burners, said plate being adapted to be pivoted from a vertical position, whereby said plate provides a wall in front of said burners, to a second position at least 90° from said vertical position, and means for maintaining said plate in said vertical position, said means for maintaining said plate in said vertical position comprising at least one collapsible brace, said collapsible brace having one end secured to said plate and the other end secured at said stove top, whereby said plate may be pivoted downwardly by collapsing said brace, and said plate can rest on said stove top.

2. A safety device for a stove which comprises, in combination, a stove top having a plurality of burners thereon and a plate pivotally mounted at the front of said stove top, said plate being forward of said burners, said plate being formed from two sections, with one section being positioned vertically above the other section, said sections being joined by a horizontal hinge, said plate being adapted to be pivoted from a vertical position, whereby said plate proves a wall in front of said burners, to a second position at least 90° from said vertical position, and means for maintaining said plate in said vertical position.

3. A safety device for a stove which comprises, in combination, a stove top having a plurality of burners thereon and a plate pivotally mounted at the front of said stove top, said plate being forward of said burners, said plate being adapted to be pivoted from a vertical position, whereby said plate provides a wall in front of said burners, to a second position at least 90° from said vertical position, means for maintaining said plate in said vertical position, additional plates pivotally mounted on each side of said stove top, whereby said additional plates provide additional safety to prevent a child from contacting any burner on said stove top from either side of said stove top, each of said additional side plates including an upper section and a lower section, with said sections being joined by a horizontal hinge, and means associated with said stove top to rest said upper sections thereon when said upper sections are pivoted relative to said lower sections.

4. The device of claim 2 wherein said horizontal hinge is of a frictional type, whereby the upper section may be pivoted relative to the lower section, and said sections will maintain their set positions relative to each other because of the frictional nature of the hinge.

5. The device of claim 3 wherein said front plate comprises an upper section and a lower section, with said sections being joined by a horizontal hinge, and said upper section can be pivoted to overly the upper section on said side plates when said side plate upper sections are pivoted inwardly toward said burners.

6. The device of claim 5 and further including means for releasably securing the upper section of said front plate to the upper sections of said side plates.

7. The device of claim 6 wherein said releasable securement is accomplished by providing pins in said upper section of said front plate and openings in the upper sections of said side plates, with said pins being engaged in said openings.

* * * * *